US005485973A

United States Patent [19]

Nellessen, Jr.

[11] Patent Number: 5,485,973

[45] Date of Patent: Jan. 23, 1996

[54] STORAGE OF CABLE

[75] Inventor: Peter Nellessen, Jr., Palm Beach Gardens, Fla.

[73] Assignee: Benthos, Inc., North Falmouth, Mass.

[21] Appl. No.: 312,500

[22] Filed: Sep. 26, 1994

Related U.S. Application Data

[63] Continuation of Ser. No. 14,422, Feb. 5, 1993, abandoned.

[51] Int. Cl.[6] ..... B65H 75/34; B63G 8/00

[52] U.S. Cl. ..... 242/386; 114/312

[58] Field of Search ..... 242/54 R, 85, 242/361.2, 386; 254/284, 285; 191/12 R, 12.2 A, 12.2 R, 12.4, 12; 114/312

[56] References Cited

U.S. PATENT DOCUMENTS

| | | | |
|---|---|---|---|
| 3,211,394 | 10/1965 | Goode | 242/386 |
| 3,236,467 | 2/1966 | Short et al. | 242/361.2 |
| 3,719,348 | 3/1973 | Wells | 242/54 R X |
| 3,940,088 | 2/1976 | Brown | 242/54 R X |
| 4,042,082 | 8/1977 | Hellmiss et al. | 191/12 R X |
| 4,324,195 | 4/1982 | Cunningham et al. | 114/312 |
| 4,406,379 | 9/1983 | Anderson et al. | 220/335 |
| 4,487,153 | 12/1984 | McMahon et al. | 242/386 |
| 4,513,922 | 4/1985 | Dufour | 242/54 R |
| 4,523,724 | 6/1985 | Rérolle | 242/54 R |
| 4,578,919 | 4/1986 | Amadon et al. | 52/645 |
| 4,590,590 | 5/1986 | Toone et al. | 367/4 |
| 4,598,882 | 7/1986 | Opdahl | 244/1 |
| 4,653,833 | 3/1987 | Czubernat et al. | 339/119 |
| 4,659,253 | 4/1987 | Jacobson | 405/171 |
| 4,666,102 | 5/1987 | Colbaugh et al. | 242/86.5 R |
| 4,686,927 | 8/1987 | Hawkes et al. | 114/312 |
| 4,721,285 | 1/1988 | McMichael | 254/333 |
| 4,731,029 | 3/1988 | Lerner et al. | 439/4 |
| 4,736,826 | 4/1988 | White et al. | 191/12.2 A |
| 4,798,156 | 1/1989 | Langeland et al. | 114/242 |
| 4,822,211 | 4/1989 | Shinoda et al. | 405/154 |
| 5,093,887 | 3/1992 | Witte | 385/135 |

FOREIGN PATENT DOCUMENTS

| | | | |
|---|---|---|---|
| 0292460 | 11/1988 | European Pat. Off. | 191/12.2 R |
| 0457683 | 11/1991 | European Pat. Off. . | |
| 3121734 | 1/1983 | Germany . | |
| 3121733 | 1/1983 | Germany . | |
| 3932433 | 4/1991 | Germany . | |
| 57-90365 | 6/1982 | Japan | 242/54 R |
| 62-96267 | 5/1987 | Japan . | |
| 518455 | 7/1976 | U.S.S.R. . | |
| 588309 | 1/1978 | U.S.S.R. . | |
| 1186535 | 6/1981 | U.S.S.R. . | |

*Primary Examiner*—John P. Darling
*Attorney, Agent, or Firm*—Fish & Richardson

[57] ABSTRACT

Cable is stored a receptacle by a coiling mechanism. In the coiling mechanism, an arm receives the cable at an axis, and supports the cable as it passes from the axis to a feed end located at a point radially spaced from the axis. A cable driver forces the cable into the arm at the axis and toward the feed end. And an arm driver assists rotation of the arm about the axis while the cable is being forced into the arm at the axis.

19 Claims, 4 Drawing Sheets

STORAGE OF CABLE

This is a continuation of application Ser. No. 08/014,422, filed Feb. 5, 1993, now abandoned.

BACKGROUND OF THE INVENTION

This invention relates to storage of cable.

Long lengths of cable must often be paid into storage containers and later paid out again. Spools and bobbins are classic cable storage devices.

SUMMARY OF THE INVENTION

In general, in one aspect, the invention features apparatus (and a corresponding method) for storing cable. The apparatus includes a receptacle for the cable, and a mechanism for coiling the cable in the receptacle. In the coiling mechanism, an arm receives the cable at an axis, and supports the cable as it passes from the axis to a feed end located at a point radially spaced from the axis. A cable driver forces the cable into the arm at the axis and toward the feed end. And an arm driver assists rotation of the arm about the axis while the cable is being delivered into the arm at the axis.

Embodiments of the invention include the following features. A controller maintains a dependency between the force applied to the cable as it is forced into the arm by the cable driver and the force applied to assist the arm in rotating about the axis. Both the cable driver and the arm driver are hydraulic motors and the controller is a common hydraulic system used to power both the cable driver and the arm driver. The cable driver and the arm are configured to impart a twist to the cable as it passes from the axis to the feed end. The arm is generally cork-screw shaped. The receptacle is an annular tray. A hold-down applies a force tending to hold the cable against the receptacle.

Other advantages and features will become apparent from the following description and from the claims.

DESCRIPTION

Figure 1:
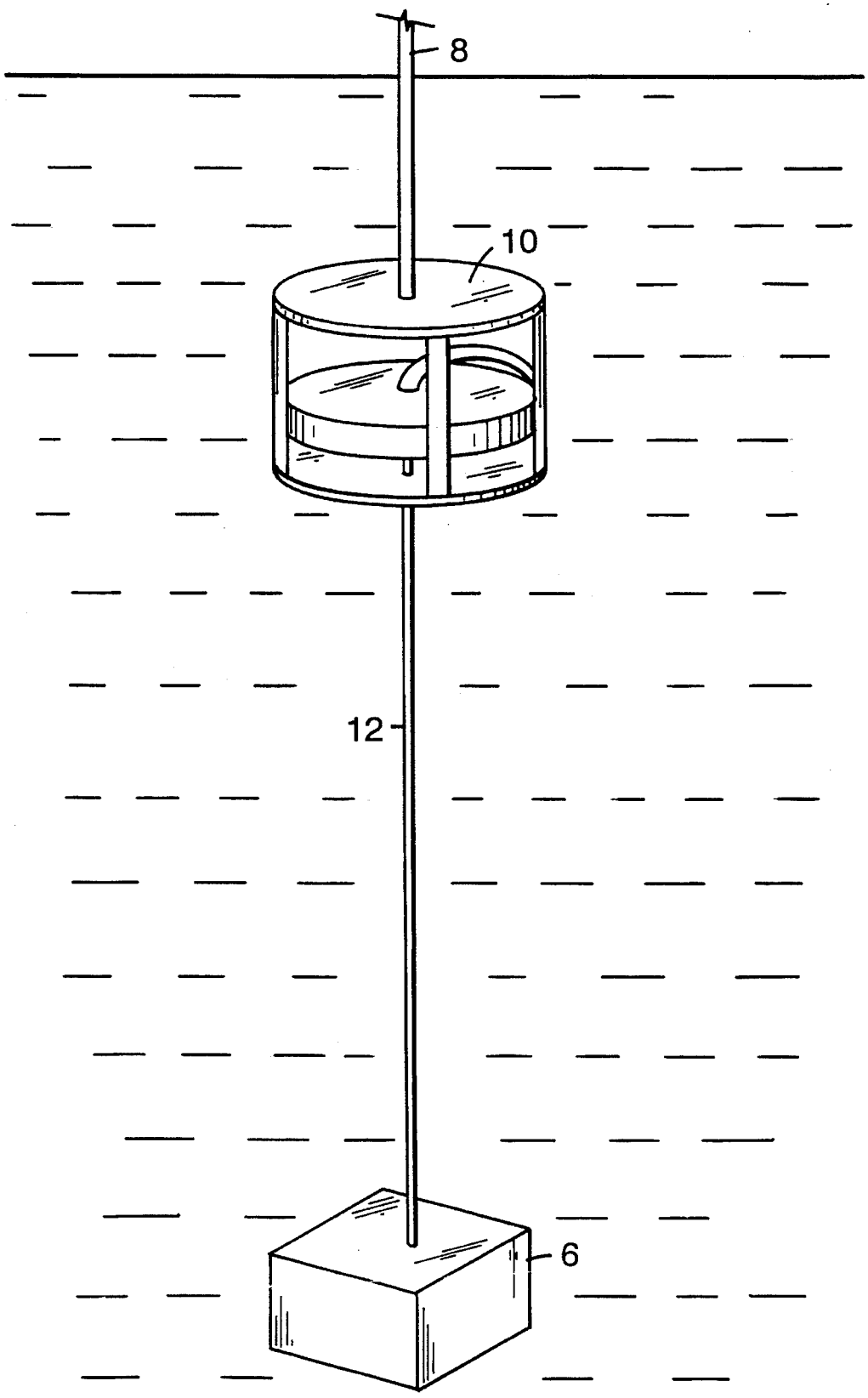
FIG. 1 is a perspective view of a cable management system and an ROV.

Referring to FIG. 1, a remotely operated vehicle (ROV) 6 is suspended under water from a tether cable 12 which can be paid out or paid in from a cable management system 10 to raise or lower the ROV. Cable management system 10 is suspended, in turn, by an armored cable 8.

Figure 2:
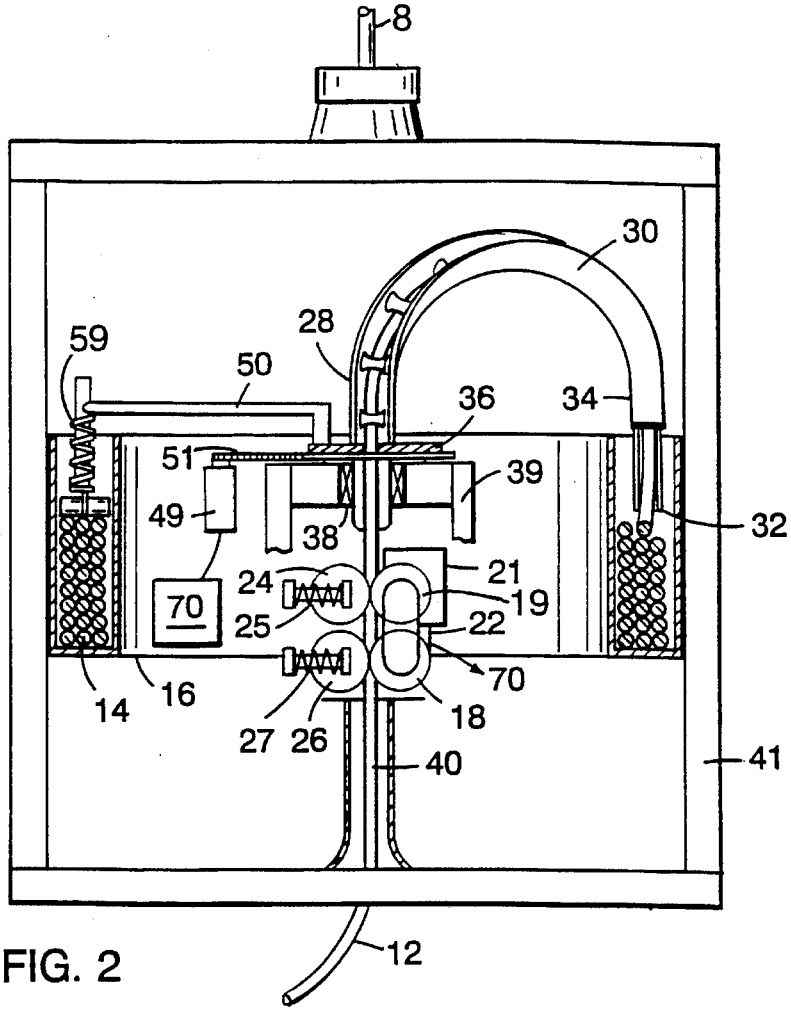
FIG. 2 is a side view, partially in section and partially cutaway, of the cable management system.
Figure 3:
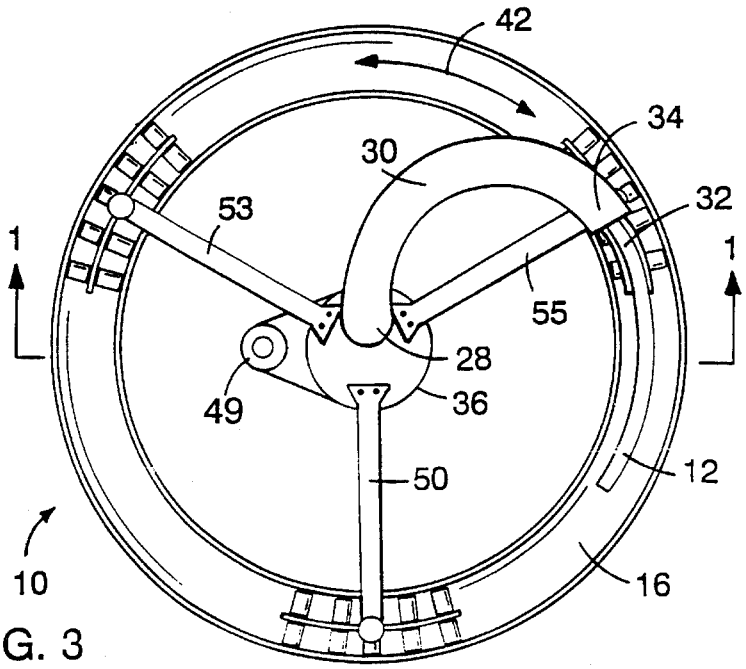
FIG. 3 is a top schematic view of cable coiling portions of the system.

Referring to FIGS. 2 and 3, cable 12 is stored in neat, concentric coils 14 in multiple layers within an annular storage tray 16. The tray is slightly wider than three widths of cable and is tall enough to accommodate many layers. Cable is paid into and out of the tray as desired by forces applied between a pair of drive rollers 18, 19 (driven via gearing 21 by a motor 22) and a corresponding pair of pinch rollers 24, 26. The drive and pinch rollers are grooved to conform to the contour of the outer surface of cable 12. The pinch rollers are biased by springs 25, 27 to force them towards the drive rollers. Thus, the drive and pinch rollers grip the cable and either force it into (for pay in) or withdraw it from (for pay out) one end 28 of a deflection arm 30. A ramp 32 at the other end 34 of the deflection arm supports the cable as it passes into or from the tray.

The deflection arm is supported on its inner end on a plate 36 which is attached to a frame 39 by a bearing 38. The bearing allows the deflection arm to rotate about an axis 40 to cause the other end 34 of the deflection arm to traverse a course around the tray (as suggested by arrow 42 in FIG. 3). The drive and pinch rollers are also mounted on frame 39. Frame 39 and tray 16 are both rigidly mounted on a main cage 41 suspended from armored cable 8.

Figure 4:
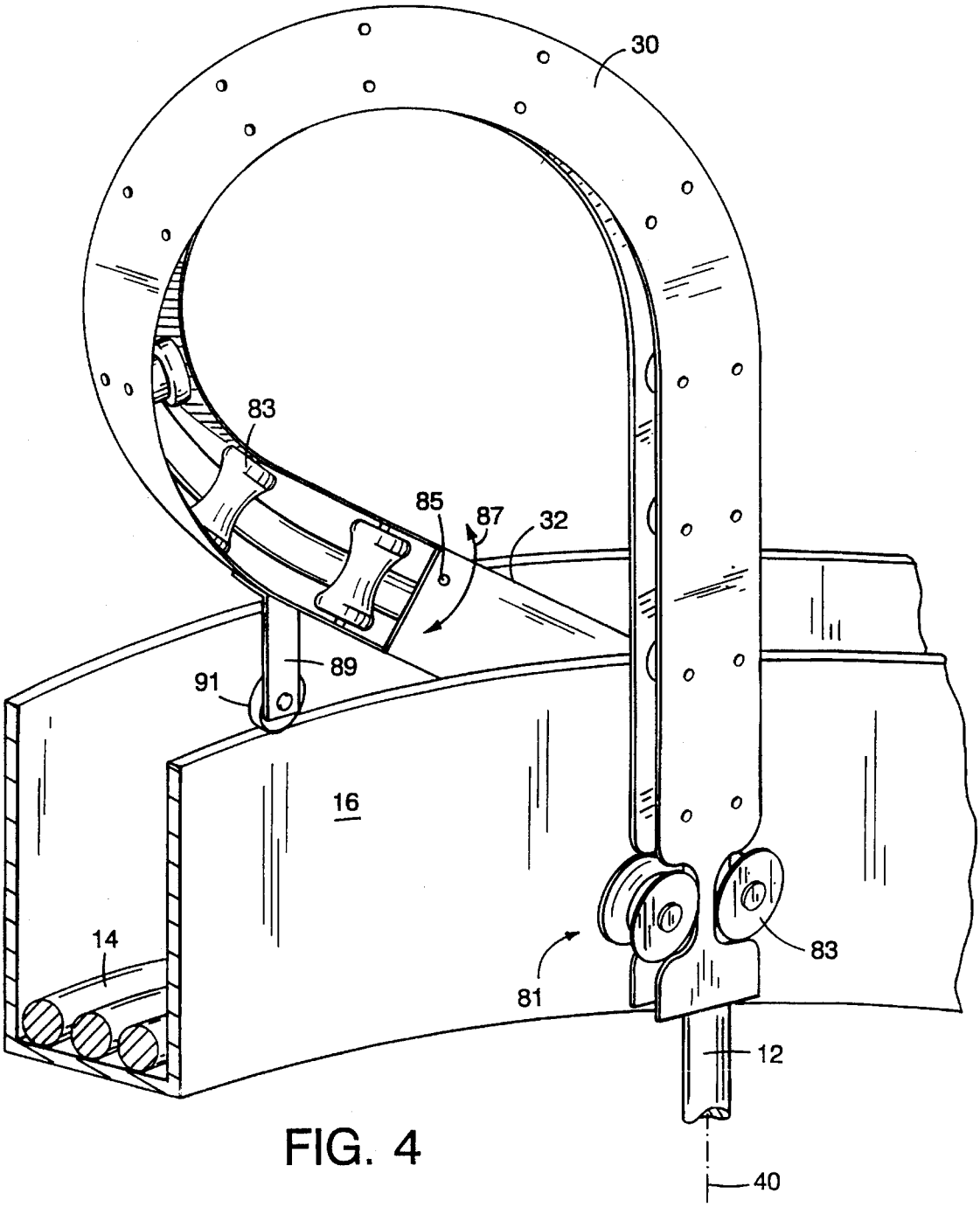
FIG. 4 is a perspective view, partially cutaway, of a deflection arm.

Referring to FIG. 4, deflection arm 30 has a corkscrew shape, and a generally rectangular cross-section at all points along its length. At regularly spaced stations 81 along the length of the deflection arm are pairs of rollers 83 mounted in parallel and spaced to accommodate the cable 12. .The rollers are contoured to conform to the outer surface of the cable. The rollers allow the cable to be smoothly bent from the centerline of the vertical axis 40 to the final orientation at the feed end 34 of the deflection arm. Ramp 32 is attached to the end of the deflection arm at a pivot point 85 to permit the arm to move up and down (as suggested by arrows 87) to adjust as the number of layers of coils in the tray increases and decreases. A bracket 89 with a guide wheel 91 supports the deflection arm as it moves along the tray.

Referring again to FIG. 2, a motor 49 is coupled via a chain drive 51 to a sprocket wheel attached to plate 36 to assist in the rotation of arm 30 as the cable is paid in or paid out. Motor 49 is mounted in a fixed position relative to frame 39.

Referring again to FIG. 3, three hold-down arms 50, 53, and 55 are mounted around plate 36 at 120 degree intervals.

Figure 5:
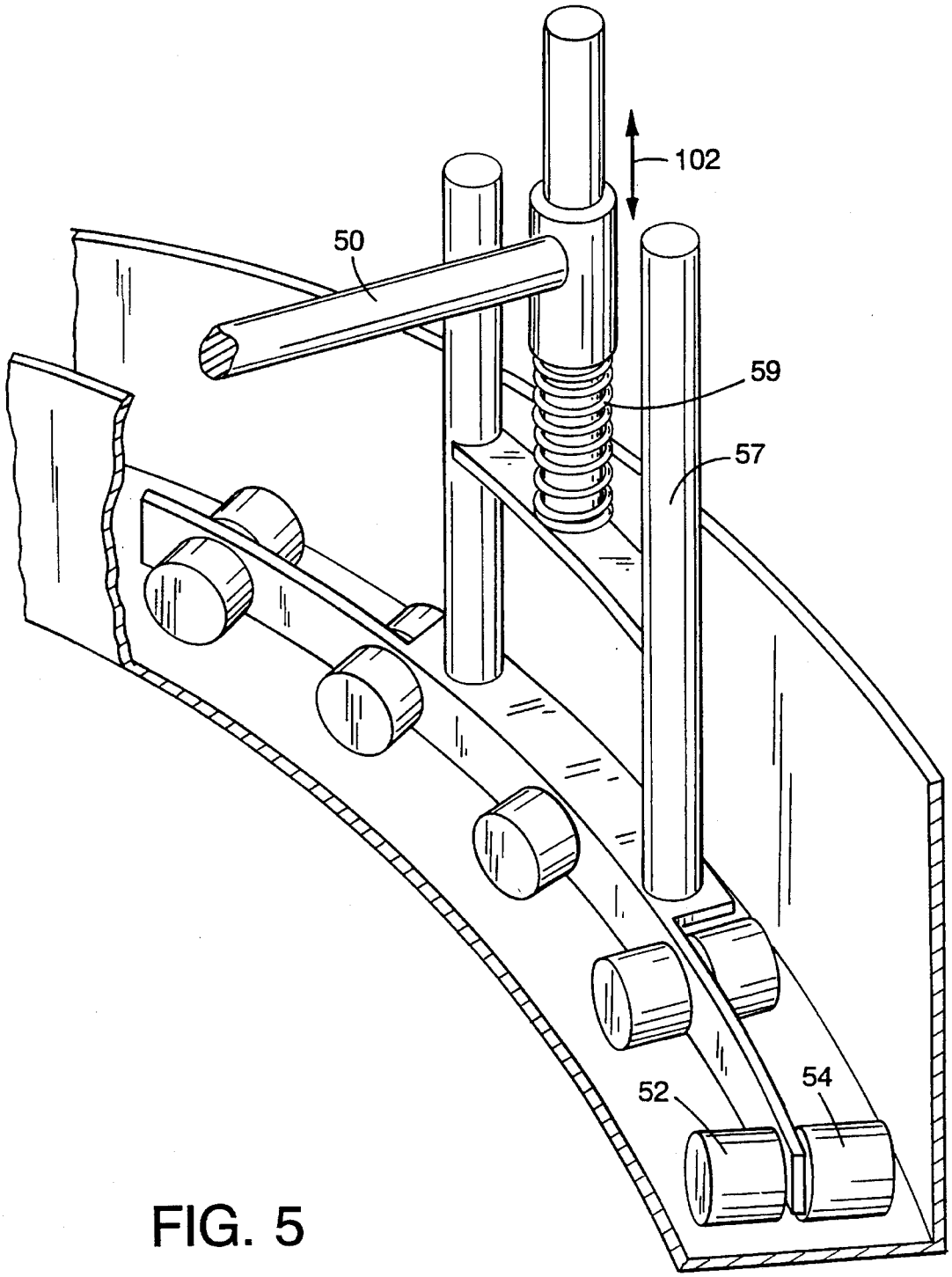
FIG. 5 is a perspective view, partially cutaway, of a hold-down mechanism.

Referring to FIG. 5, each hold-down arm supports a floating assembly 57 on which are mounted a series of pairs of hold-down roller wheels 52, 54 which lie within the tray. A spring 59 urges assembly 57 downward to apply pressure to the upper layer of cable coils. The assembly floats up and down as suggested by arrow 102.

In a mode when the cable is being paid into the collection tray, a continual gentle twist is imparted to the cable which produces a total of 360 degrees of twist for a 360 degree rotation of the deflection arm about the tray. This helps to assure that the cable will be laid down in neat concentric coils in the tray and without twisting stresses at any point along the cable.

The continual gentle twist is imparted to the cable by a combination of effects. The drive and pinch rollers 18, 19, 24, 26 grasp the cable tightly enough to prevent any rotation of the cable around its own axis at that point. The rollers are mounted in a fixed position relative to the tray so that as the arm rotates the cable is twisted and at the same time paid out into the tray. The contour of the deflection arm provides the desired twisting of the cable and allows for smoother delivery of the cable to the tray than if the deflection arm were simply radial to the axis. The rollers spaced along the deflection arm aid the smooth delivery of the cable.

When paying cable in, the drive rollers push the cable into and along the deflection arm to the ramp and then along the ramp to the bottom of the tray. When the cable contacts the bottom of the tray, the force causes the cable to push against and to start laying a first coil along the outer wall of the tray. At the same time, the stiffness of the cable causes a reaction force which naturally pushes the deflection arm and the hold-down arms around the tray. The hold-down arms help the cable to lay in concentric layers starting with the first coil on the outer side of the tray. The second and third coils form inwardly of the first coil as they push against the tray bottom. When three coils are in the bottom of the tray, the cable makes a crossover from the inside wall to the outside wall of the tray and starts another layer of cable on the outside wall.

As more layers of cable are put into the tray, the hold-down arm springs compress to produce higher downward forces on the cable. This in turn causes the drive rollers to produce more drive force to overcome the resistance of the hold down rollers. This higher drive force is applied to the cable as it exits the ramp and would tend to cause the cable to pile up at the outer wall of tray, eventually jamming and causing the drive rollers either to slip or to stop turning.

The addition of the deflection arm drive prevents the cable from jamming in this way and gives more uniform cable lays. Because the drive roller motor and the deflection arm motor are both hydraulic units driven from the same hydraulic source 70, they cooperate to prevent cable jamming. The deflection arm drive is connected so that on paying cable in, it drives the deflection arm in the same direction it would normally travel by force from the cable alone. On paying cable out, the arm is driven in the reverse direction, i.e., the direction it would normally travel by force from the cable being paid out. The net result is to reduce the tendency of the cable to pile up on the outside of the tray and to impart a more neutral exit point in the tray for the cable as it leaves the ramp. The arm drive also helps compensate for increased spring force on the cable as more cable is added to the tray. The arm drive components are carefully selected by experimentation so that the arm drive does not overpower the driving force generated by the drive rollers. If this were to occur, the cable would always want to pile up on the inside wall of the tray.

Because motor 22 and motor 49 are driven from a common hydraulic supply, as the force applied by the drive rollers 18, 19 to the cable increases (decreases), the force applied to the rotation of the deflection arm also increases (decreases) assuring that the cable will continue to have no net lateral force applied to it as it exits the deflection arm at the tray.

The hold-down rollers help to prevent the cable from coming out of the tray in cases in situations where the whole system is submerged, or is subjected to significant motion or forces.

In the mode where the cable is being paid out, the reverse process occurs, with the cable being pulled by the drive and pinch rollers from the axis end of the deflection arm. Now the pinching of the cable causes a reverse twisting of the cable so that it is paid out with no net torque operating on it.

Other embodiments are within the scope of the following claims.

For example, the system is equally applicable to (and the word "cable" when used in the claims is meant to apply equally to at least) hose or any other strand or rope or fiber which could be forced into the deflection arm and subjected to the twisting described above.

Other motors could be used, including electric or pneumatic.

The system may be configured to permit either clockwise or counterclockwise pay-in and pay-out of the cable.

Larger numbers of drive rollers can be used to provide larger drive forces on the cable.

What is claimed is:

1. Apparatus for storing cable comprising a receptacle for the cable, and a mechanism for coiling the cable in the receptacle, the mechanism comprising an arm mounted at an axis to receive the cable and to deliver the cable to a feed end, a cable driver mounted to force the cable into the arm at the axis and toward the feed end causing rotation of the arm about the axis, and a distinct arm driver mounted to assist rotation of the arm about the axis while the cable is being delivered into the arm at the axis, the cable driver and the arm being configured to impart a twist to the cable as it passes from the axis to the free end.

2. The apparatus of claim 1 further comprising a controller to maintain a dependency between the force applied to the cable as it is forced into the arm by the cable driver and the force applied to assist the arm in rotating about the axis.

3. The apparatus of claim 2 wherein both the cable driver and the arm driver comprise hydraulic motors and the controller comprises a common hydraulic system used to power both the cable driver and the arm driver.

4. The apparatus of claim 1 wherein the arm is generally cork-screw shaped.

5. The apparatus of claim 1 adapted also for removing the cable from the receptacle by causing the cable driver to pull the cable from the arm.

6. The apparatus of claim 1 wherein the receiving end of the arm is spaced from the receptacle in a first direction, and the cable is fed into the receiving end of the arm in the first direction.

7. The apparatus of claim 1 wherein the cable driver is mounted in a fixed rotational position relative to the receptacle, and grasps the cable to prevent rotation of the cable around the cable axis at the position of the cable driver, so that as the arm rotates relative to the cable driver, the cable is gently twisted by means of the contour of the arm.

8. Apparatus for storing cable comprising an annular receptacle for the cable, a mechanism for coiling the cable in the receptacle, the mechanism comprising a cork-screw shaped arm mounted to receive the cable at an axis, and to deliver the cable from the axis to a feed end located at a point radially spaced from the axis, a cable driver mounted to push the cable into the arm at the axis and toward the feed end, an arm driver mounted to assist rotation of the arm about the axis while the cable is being pushed into the arm at the axis, and the cable driver and the arm being configured to impart a twist to the cable as it passes from the axis to the feed end, a hold-down for applying a force tending to hold the cable down against a bottom of the receptacle, and a controller to maintain a dependency between the force applied to the cable as it is pushed into the arm by the cable driver and the force applied to assist the arm in rotating about the axis.

9. A method for storing cable comprising providing a receptacle for the cable, mounting an arm at an axis to receive the cable, and to deliver the cable from the axis to a feed end, and coiling the cable in the receptacle, by forcing the cable into the arm at the axis and toward the feed end causing rotation of the arm about the axis, and simultaneously and distinctly assisting rotation of the arm about the axis, and imparting a twist to the cable as it passes from the axis to the feed end.

10. A method for storing cable comprising providing a receptacle for the cable, mounting an arm at an axis to receive the cable, and to deliver the cable from the axis to a feed end, and coiling the cable in the receptacle, by forcing the cable into the arm at the axis and toward the feed end, wherein a twist is imparted to the cable as it passes from the axis to the feed end.

11. The method of claim 10 further comprising simultaneously and distinctly assisting rotation of the arm about the axis.

12. The method of claims 9 or 11 further comprising maintaining a dependency between the force applied to the cable as it is forced into the arm by the cable driver and the force applied to assist the arm in rotating about the axis.

13. Apparatus for storing cable comprising a receptacle for the cable, and a mechanism for coiling the cable in the receptacle, the mechanism comprising an arm mounted at an axis to receive the cable, and to deliver the cable to a feed end located at a point radially spaced from the axis, and a cable driver mounted to force the cable into the arm at the axis and toward the feed end, wherein the cable driver and the arm are configured to impart a twist to the cable as it passes from the axis to the feed end.

14. Apparatus for storing cable comprising a receptacle for the cable, and a mechanism for coiling the cable in the receptacle, the mechanism comprising a corkscrew-shaped arm mounted at an axis to receive the cable, and to deliver the cable to a feed end located at a point radially spaced from the axis, and a cable driver mounted to force the cable into the arm at the axis and toward the feed end, wherein the cable driver and the arm are configured to impart a twist to the cable as it passes from the axis to the feed end.

15. Apparatus for storing cable comprising a receptacle for the cable, and a mechanism for coiling the cable in the receptacle, the mechanism comprising an arm mounted at an axis to receive the cable, and to deliver the cable to a feed end located at a point radially spaced from the axis, and a cable driver mounted to force the cable into the arm at the axis and toward the feed end, wherein the cable driver is mounted in a fixed rotational position relative to the receptacle, and grasps the cable to prevent rotation of the cable around the cable axis at the position of the cable driver, so that as the arm rotates relative to the cable driver, the cable is gently twisted by means of the contour of the arm.

16. The apparatus of claims 1, 13, 14, or 15 wherein the receptacle is an annular tray.

17. The apparatus of claims 1, 13, 14, or 15 comprising a hold-down for applying a downward force tending to hold the cable against a bottom of the receptacle.

18. The apparatus of claims 13, 14, or 15 further comprising an arm driver mounted to assist rotation of the arm about the axis while the cable is being delivered into the arm at the axis.

19. The apparatus of claim 18 further comprising a controller to maintain a dependency between the force applied to the cable as it is forced into the arm by the cable driver and the force applied to assist the arm in rotating about the axis.

* * * * *

UNITED STATES PATENT AND TRADEMARK OFFICE

CERTIFICATE OF CORRECTION

PATENT NO. : 5,485,973

DATED : January 23, 1996

INVENTOR(S) : Peter Nellessen, Jr.

It is certified that error appears in the above-identified patent and that said Letters Patent is herebv corrected as shown below: On the title page: Item [56]

The following references should be inserted:

U.S. Patent 3,854,698, 12/17/74, Ferrentino . 254/190R

U.S. Patent 4,535,946, 08/20/85, Thevenon . . 242/54R

Under Foreign Documents insert the following:

GB Patent 1213037, 11/18/70

GB Patent 855402, 11/30/60

Signed and Sealed this

Ninth Day of December, 1997

Bruce Lehman

*Attest:*

BRUCE LEHMAN

*Attesting Officer*

*Commissioner of Patents and Trademarks*